United States Patent [19]

Kamada

[11] Patent Number: 4,514,861

[45] Date of Patent: May 7, 1985

[54] GOLF GLOVES

[75] Inventor: Toshihiko Kamada, Kagawa, Japan

[73] Assignee: Kamatari Co., Ltd., Kagawa, Japan

[21] Appl. No.: 568,568

[22] Filed: Jan. 6, 1984

[30] Foreign Application Priority Data

Jun. 8, 1983 [JP] Japan ..... 58-88100[U]

[51] Int. Cl.[3] ..... A41D 19/00

[52] U.S. Cl. ..... 2/161 A; 2/169

[58] Field of Search ..... 2/16, 17, 19–21, 2/158–163, 169, DIG. 4; D2/360, 361, 368–377

[56] References Cited

U.S. PATENT DOCUMENTS

| | | | |
|---|---|---|---|
| 1,238,804 | 9/1917 | Ostermann | 2/169 |
| 1,699,495 | 1/1929 | Sturm | 2/161 R |
| 2,048,793 | 7/1936 | Johanson | 2/169 |
| 4,051,552 | 10/1977 | Widdemer | 2/161 A |

*Primary Examiner*—Werner H. Schroeder
*Assistant Examiner*—Joseph S. Machuga
*Attorney, Agent, or Firm*—Millen & White

[57] ABSTRACT

A golf glove is provided wherein the lateral sides of outer and inner wall members of finger compartments thereof are respectively sewn together as twisted in a direction opposite to the direction of and in an amount substantially equal to the amount of twist of said finger compartments that occurs with respect to fingers when a golf club is gripped with the glove.

4 Claims, 8 Drawing Figures

GOLF GLOVES

BACKGROUND OF THE INVENTION

The present invention relates to golf gloves.

When a golfer puts on a golf glove and holds the grip of a golf club as shown in FIG. 1 of the accompanying drawings, it is common practice to first hold the grip G gently with his index finger remaining extended and, then, grip the grip G firmly by twisting his wrist toward the thumb (in the direction of the arrow-mark A). However, when the wrist is so twisted, the finger compartments other than the thumb compartment of a left-handed glove is twisted counterclockwise (in the direction indicated by the arrowmark B'), with the result that the finger compartments 6 whose inner wall members are tightly compressed against the grip G are subjected to a force displacing them with respect to fingers in a clockwise direction as viewed from the fingertip side (in the direction indicated by the arrowmark B). In the case of a glove for the right hand, the twisting effect of gripping the grip G on the finger compartments is reverse, that is to say, the finger compartments of the glove tend to be displaced in a counterclockwise direction with respect to the fingers.

In the conventional glove illustrated in FIGS. 2 and 3, the seams P and Q of the component wall members defining each finger compartment 6 (i.e. outer member 16, inner member 26 and girth 36) are generally linear along the length of the finger compartment 6 (i.e. without a twist), and when the glove is put on, each of the finger compartments 6 is located in the normal position (untwisted position) with respect to the corresponding finger. However, when one wearing this glove holds the grip G of the golf club, the above-mentioned twisting force on the finger compartments 6 causes the compartments to be twisted in a clockwise direction (the direction indicated by the arrowmark B) with respect to the fingers as viewed from the fingertip side as illustrated in FIG. 4 so that the seams P, Q of the glove compartments 6 are also displaced clockwise with respect to the fingers, with the result that the wearing comfort and appearance of the glove are adversely affected.

BRIEF SUMMARY OF THE INVENTION

In view of the above-mentioned disadvantages of the conventional golf glove, it is a main object of the present invention to provide a golf glove wherein the seams of its glove compartments are located on the wearer of the glove gripping the golf club in said normal positions (untwisted positions with respect to the fingers). Thus, the golf glove according to the present invention is characterized in that lateral sides of the outer and inner wall members defining its finger compartments are respectively sewn together as pre-twisted in a direction opposite to the direction of, and in an amount substantially equal to the amount of twist that would be produced when a golf club was gripped with the glove.

DESCRIPTION OF THE PREFERRED EMBODIMENT

Figure 5:
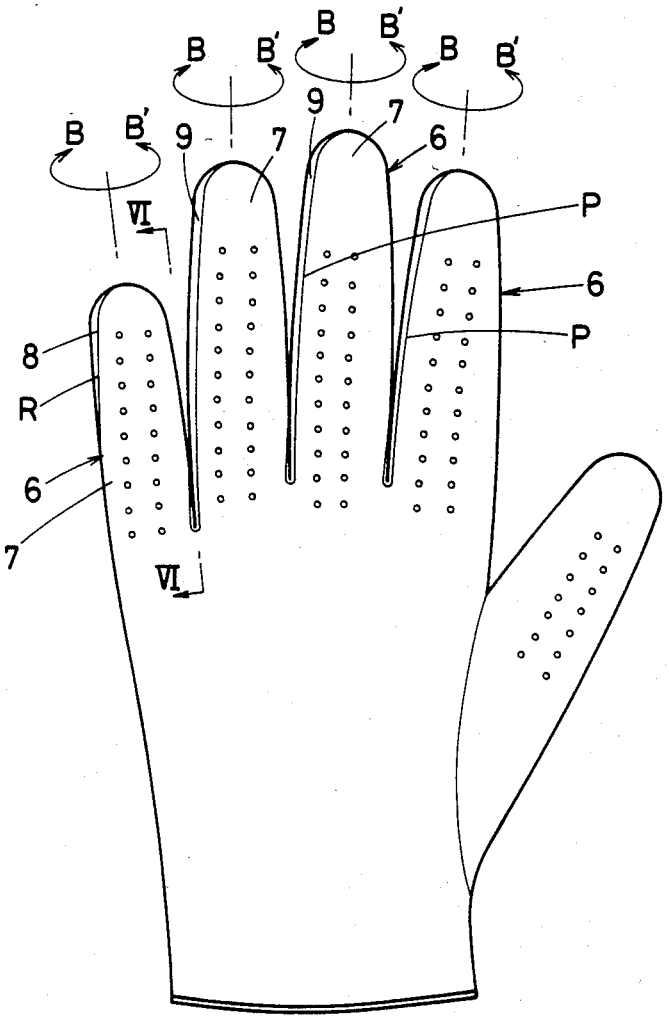
FIG. 5 is a plan view of the golf glove according to a preferred embodiment of the present invention.
Figure 6:
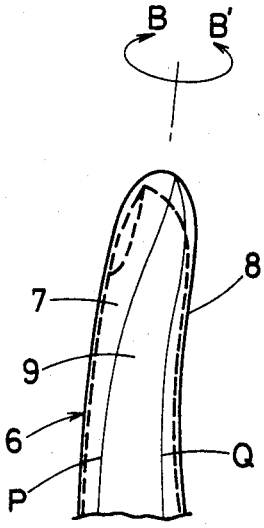
FIG. 6 is a view taken along the line VI—VI of FIG. 5.
Figure 7:
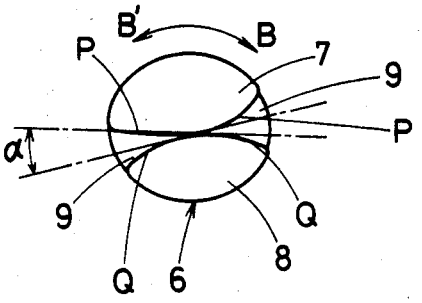
FIG. 7 is a top view of a finger compartment of the glove of FIG. 5 as viewed from the fingertip side.
Figure 8:
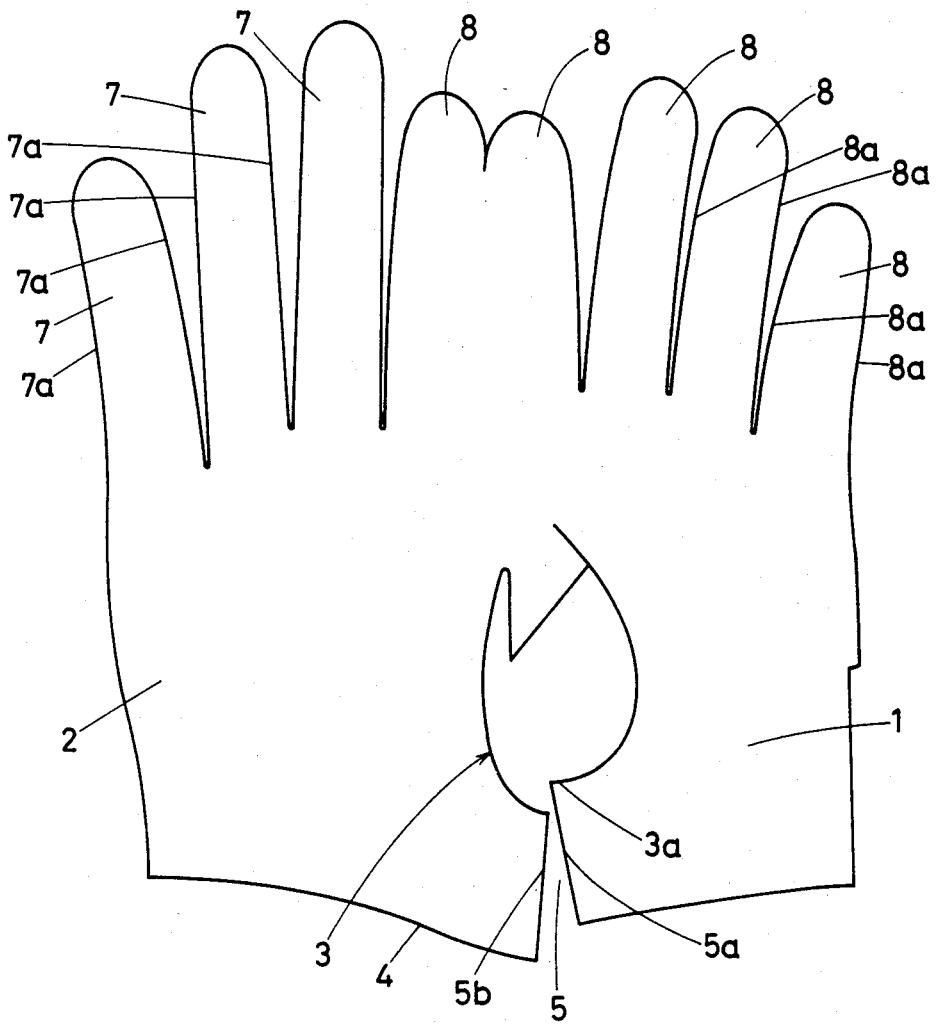
FIG. 8 is a development view of the golf glove of FIG. 5.

The golf glove according to the present invention will be hereinafter be described in detail, reference being had to the embodiment shown in FIGS. 5 to 8. The golf glove illustrated in FIGS. 5 to 7 is constructed of a comparatively flexible raw material such as leather. Of this glove, four finger compartments 6, except one compartment for the thumb, are respectively defined by outer wall members 7, flat inner wall members 8, and girth members 9 and are formed by sewing together the respective three different members along their peripheries, with the girth member disposed between said outer and inner wall members. The lateral edges 7*a* (See FIG. 8) of the outer wall member 7 are sewn to the corresponding lateral edges of the girth member 9 as shown by the seam P, while the lateral edges 8, 8*a* (FIG. 8) of each flat inner wall member 8 are sewn to the corresponding lateral edges of the girth member 9 along the seam Q. As shown in FIG. 8, the lateral edges of said outer wall member 7 and inner wall member 8 defining the index finger compartment are continuous on the thumb side by leaving the area uncut at cutting the glove blank out of the material sheet, and the lateral edges 7*a*, 8*a* of the outer and inner wall members 7, 8 defining the little finger compartment on the side remote from the thumb are directly sewn together without interposition of a girth member (seam R).

When a golfer wearing the golf glove thus constructed (for example, the glove for the left hand) holds the grip G of a golf club firmly (FIG. 1), the four finger compartments 6 other than the thumb compartment are respectively twisted clockwise (arrowmark B) as viewed from the fingertip side with respect to the fingers to generate a relative displacement between each finger compartment and the corresponding finger, and the amount of said relative displacement between the finger compartment and finger varies with different finger compartments. The finger compartments 6 of the illustrated glove are produced by sewing together the respective pairs of their wall members as pretwisted by the amounts equal to said relative displacements between the finger components and fingers that are produced when the golfer wearing the glove grips the club. Thus, of said four finger compartments (the compartments for the index finger, middle finger, third finger and little finger) 6, three compartments excepting the one for the index finger are provided by cutting the glove blank out from the sheet material in such a manner that the outer wall members 7, 7, 7 and inner wall members 8, 8, 8 are inclined through certain degrees in a direction opposite to the thumb side as shown in FIG. 8 and the four sets of outer wall members 7, inner wall members 8 and intermediary girth members 9 are respectively sewn together as pretwisted counterclockwise as viewed from the fingertip side (arrowmark B')

by the amounts (e.g. angle $\alpha$ in FIG. 7) equal to the twists produced on the golfer wearing the glove gripping the golf club. Accordingly, the seams P, Q between the respective outer and inner wall members and the corresponding girth members 9 are also pretwisted counterclockwise as viewed from the fingertip side.

In cutting the blank for this glove from a sheet material, a cut is made from the edge 3*a* of the opening for communicating with a thumb compartment 3 on the hand insertion side to the edge 4 for defining a hand insertion opening as illustrated in FIG. 8. Moreover, the cut is made in such a manner that a downwardly flared space 5 is formed between said opening for the thumb compartment 3 and said edge 4 (FIG. 8) and that the cut edge 5*a* on the inner wall member side is displaced nearer to the fingers than is the cut edge 5*b* on the outer wall member side. In sewing, the cut edge 5*a* on the inner wall member side is pulled in a direction opposite to the fingers (toward the hand insertion opening) relatively with respect to the cut edge 5*b* on the outer wall member side until the two cut edges 5*a* and 5*b* are brought into perfect register. In this manner, no slack is produced in the material on the inner wall member side so that the wearing comfort of the glove is improved.

Figure 1:
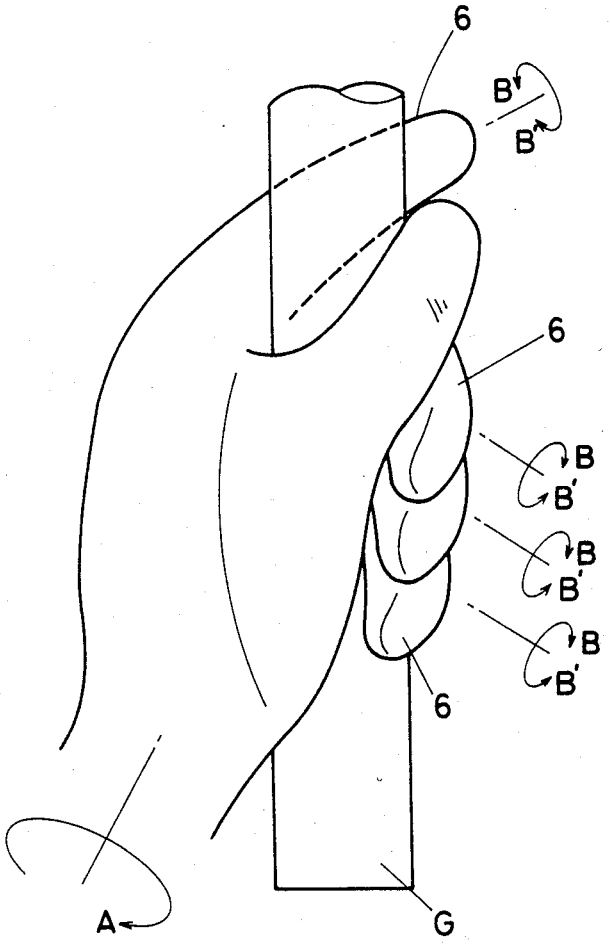
Fig. 1 PRIOR ART
FIG. 1 is a schematic illustration a glove with which a golf club is being gripped.
Figure 2:
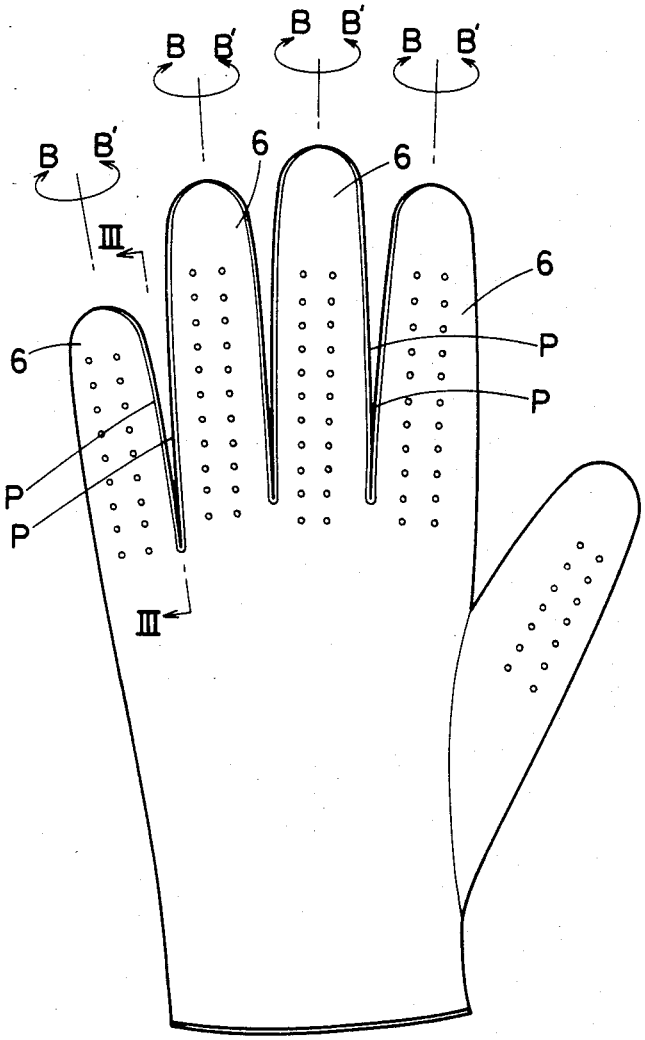
Fig. 2 PRIOR ART
FIG. 2 is a plan view showing a golf glove of conventional design.
Figure 3:
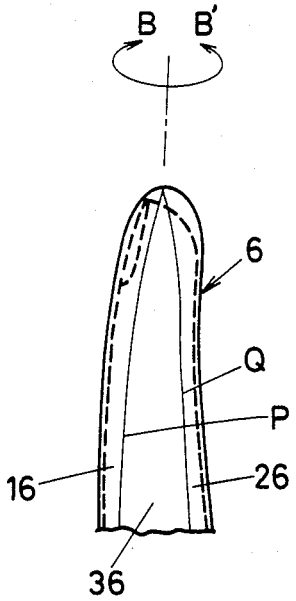
Fig. 3 PRIOR ART
FIG. 3 is a view taken along the line III—III of FIG. 2.
Figure 4:
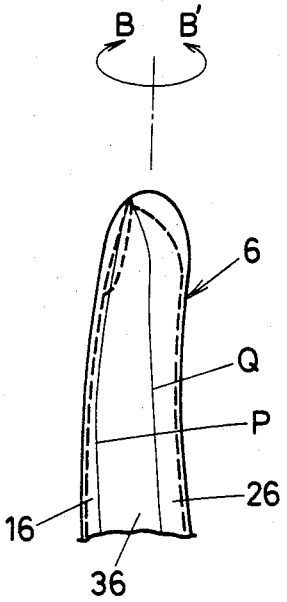
Fig. 4 PRIOR ART
FIG. 4 is a view similar to FIG. 3 showing the effect of twisting force upon finger compartments of the conventional golf glove shown in FIG. 2.

The functional advantage of the above glove construction will be explained below. As shown in FIG. 1, when one wears the glove of this embodiment and holds the grip G of a golf club firmly, the four finger compartments except the thumb compartment are respectively twisted in the direction of arrowmark B with respect to the corresponding fingers but since the finger compartments 6 have been formed by sewing their component members pretwisted in the direction of arrowmark B' by the amounts equal to the twists produced on gripping the club, the seams P, Q between the outer and inner wall members and girth member 7, 8, 9 of each finger compartment 6 are brought into the proper positions (in alignment with the lengths of fingers). Thus, not only the wearing comfort of the glove but also its appearance is improved.

I claim:

1. A golf glove characterized in that the lateral sides of outer and inner wall members of finger compartments thereof are respectively sewn together as twisted in a direction opposite to the direction of and in amount substantially equal to the amount of twist of said finger compartments that occurs with respect to fingers when a golf club is gripped with the glove.

2. The golf glove according to claim 1, wherein the four finger compartments except one for the thumb are respectively defined by outer wall members, flat inner wall members and girth members and are formed by sewing together the respective three different members along therein peripheries with the girth members disposed between said outer and inner wall members, said outer and inner members defining the index finger compartment being continuous on the thumb side while the lateral edges of said outer and inner wall members defining the little finger compartment on the side remote from the thumb being directly sewn together without interposition of a girth member, and wherein said four finger compartments each defines seams between said members which are normally twisted counterclockwise for the left hand glove and clockwise for the right hand glove toward the fingertip side by said amount of twist.

3. The golf glove according to claim 2, wherein said outer and inner wall members respectively defining three compartments for the middle, third and little fingers, when developed into a flat unsewn configuration, are inclined through certain degrees in a direction opposite to the thumb side.

4. The golf glove according to claim 3, wherein inner and outer wall members adjacent a hand insertion edge are sewn together from the thumb compartment to said edge such that the inner wall member is normally pulled relative to the outer wall member in a direction opposite to the fingertips whereby no slack is produced in the material on the inner wall member upon use.

* * * * *